United States Patent [19]

Taniguchi et al.

[11] 4,024,749

[45] May 24, 1977

[54] THREE-DIMENSIONAL WORK FEED DEVICE IN A TRANSFER PRESS

[75] Inventors: Naonori Taniguchi; Shozo Imanishi, both of Sagamihara, Japan

[73] Assignee: Aida Engineering Ltd., Sagamihara, Japan

[22] Filed: July 14, 1976

[21] Appl. No.: 705,015

[30] Foreign Application Priority Data

July 22, 1975 Japan ..... 50-88897

[52] U.S. Cl. ..... 72/421; 72/405

[51] Int. Cl.[2] ..... B21D 43/02

[58] Field of Search ..... 72/421, 405, 404

[56] References Cited

UNITED STATES PATENTS

| | | | |
|---|---|---|---|
| 3,011,464 | 5/1961 | Danly | 72/405 |
| 3,025,731 | 3/1962 | Jacobs | 72/405 |
| 3,079,817 | 3/1963 | Sanford | 72/405 |
| 3,105,399 | 10/1963 | Strugala | 72/405 |
| 3,512,391 | 5/1970 | Bozich | 72/405 |
| 3,541,834 | 11/1970 | Wallis | 72/405 |

FOREIGN PATENTS OR APPLICATIONS

| | | | |
|---|---|---|---|
| 1,370,686 | 10/1974 | United Kingdom | 72/405 |

*Primary Examiner*—C.W. Lanham
*Assistant Examiner*—Gene P. Crosby

[57] ABSTRACT

A three-dimensional feed device in a transfer press is disclosed having a pair of feed bars each respectively supported by a pair of feed bar guides having an integral guide plate provided with a through axial bore. Crank shafts each have an eccentric portion loosely extending through the axial bore. A drive shaft is connected to one of the shafts and slidably received in a slide block slidably provided in a stationary casing. A stationary internal sun gear is secured to the casing. A planetary gear meshes with the sun gear and is rotatably supported in a rotary support member coaxial with said sun gear. The planetary gear has an eccentric pin. A slidable rack is supported on the eccentric pin in the casing at right angles to the slidable movement direction of the slide block and a pinion is secured to said drive shaft and meshes with the slidable rack.

4 Claims, 16 Drawing Figures

THREE-DIMENSIONAL WORK FEED DEVICE IN A TRANSFER PRESS

BACKGROUND OF THE INVENTION

This invention relates to a transfer press and more particularly, to a device in the transfer press for feeding a work through successive operation stations in the transfer press by three-dimensional movement of feed bars in the press.

The three-dimensional movement referred to herein means the movement involving the actions of the feed bars such as (a) clamping, (b) lifting, (c) advance, (d) descent, (e) unclamping and (f) return as seen in FIG. 1.

As conventional three-dimensional feed mechanisms in transfer presses, the so-called cam-, lever- and planetary gear-type feed mechanisms have been well known. However, these prior art three-dimensional feed mechanisms can not satisfy the requirements that the construction is compact, that the lifting and clamping actions are provided by a common single drive source, that the translation from the clamping action to the lifting action and that from the descending action to the unclamping action are perpendicularly effected eliminating any laptime between the successive actions and acceleration and deceleration of the actions are smooth to thereby perform the feed operation at high rates.

SUMMARY OF THE INVENTION

Therefore, the purpose of the present invention is to provide a three-dimensional feed device for a transfer press which satisfies the above-mentioned requirements called for the press feed device.

The above and other objects and attendant advantages of the present invention will be more readily apparent to those skilled in the art from a reading of the following detailed description in conjunction with the accompanying drawings which show a preferred embodiment of the present invention for illustration purpose only, but not for limiting the scope of the same in any way.

BRIEF DESCRIPTION OF THE DRAWINGS

FIG. 8 through 16 show one embodiment of three-dimensional feed device constructed in accordance with the present invention in which:

FIG. 8 is a top plan view of a transfer press providing three-dimensional feed device;

FIG. 9 is a cross-sectional view on an enlarged scale taken along substantially the X — X line of FIG. 8 showing the clamp lift unit associated with the left-hand column;

FIG. 10 is a cross-sectional view on a further enlarged scale taken along substantially the Y — Y line in the central portion of said clamp lift unit;

FIG. 11 is a top plan view in partial section of said central portion of the clamp lift unit as shown in FIG. 10;

FIG. 12 is a cross-sectional view taken along substantially the V — V line of FIG. 10;

FIG. 13 is a cross-sectional view taken along substantially the Y — Y of FIG. 8 showing the clamp lift drive unit associated with the left-hand column;

FIG. 14 is a cross-sectional view taken along substantially the Z — Z and K — K lines of FIG. 13;

FIG. 15 is a cross-sectional view taken along substantially the W — W line of FIG. 14; and FIG. 16 is a front elevational view on an enlarged scale showing the relationship between the slide of the transfer press and the three-dimensional feed device of the present invention.

PREFERRED EMBODIMENT OF THE INVENTION

Figure 1:
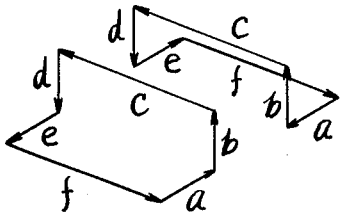
FIG. 1 is an explanatory view showing the three-dimensional feed mode of the feed bars in a transfer press.
Figure 2:
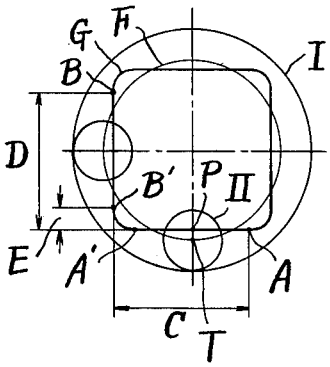
FIG. 2 is a locus view of the eccentric point of the planetary gear meshing the internal sun gear and having the tooth number ratio of 1 : 4 to the latter.
Figure 3:
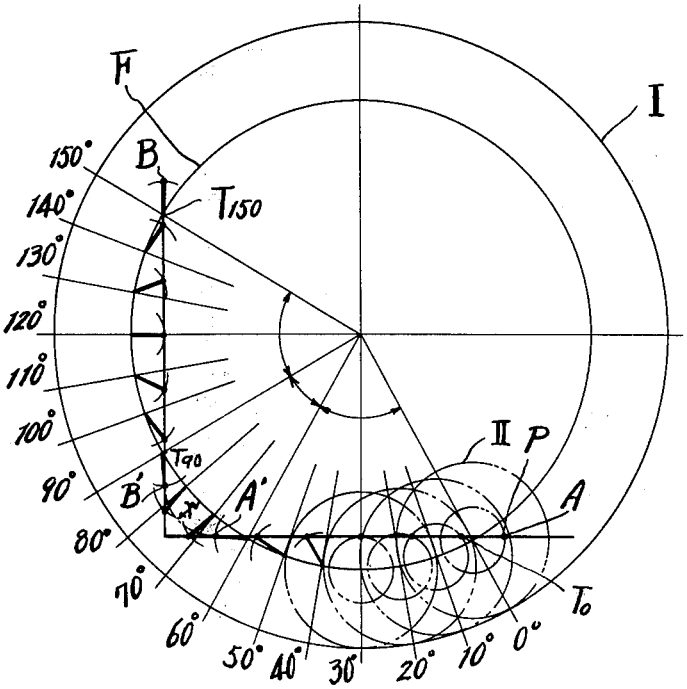
FIG. 3 is an enlarged view of FIG. 2 showing a portion of the same in detail.

The present invention will be now described referring to the accompanying drawings and more particularly, to FIGS. 2 and 3 in which the principle of the present invention is shown. In these Figures, a planetary gear II meshes a stationary internal sun gear I and has the tooth number ratio of 1 : 4 with respect to the sun gear. As seen in these Figures, when the meshing planetary gear II revolves round the sun gear I while rotating about its own axis or center T, the locus described by the center T of the planetary gear II will become that as shown by F in FIG. 2 and the locus described by the eccentric point P of the planetary gear II which is eccentric with respect to one center T of the planetary gear by a distance corresponding to one fifth of the basic circle will become that as shown by G in FIG. 2.

According to the present invention, the planetary gear II is imparted thereto a reciprocal movement in which the eccentric point P first moves from Point A to Point B along the above-mentioned locus G and then from Point B to Point A, the movement distance C is utilized as the clamping stroke of the feed bars and the movement distance D is utilized as the lifting stroke of the feed bars. In this case, as the eccentric point P passes from the clamping stroke C to the lifting stroke D and from the lifting stroke D back to the clamping stroke C, if the eccentric Point P describes a circular arc *r*, there are the difficulties that the lifting operation by the feed bars begins before the preceding clamping operation by the bars completes and that the unclamping operation begins before the downward stroke completes. In order to eliminate the difficulties, according to the present invention, the translation from the clamping stroke to the lifting stroke and the translation from the downward stroke to the unclamping stroke are designed to be right angled movement, respectively.

FIG. 3 shows details of the locus described by the eccentric point P as that the eccentric point moves from Point A to Point B. The movement distance of the center T of the planetary gear II from the starting Point $T_0$ to the transit Point $T_{90}$ displaced by 90° from the staring Point $T_0$ with respect to the center of the sun gear I is utilized as the clamping stroke and the movement distance of the center T further from the transit Point $T_{90}$ to the transit $T_{150}$ is utilized as the lifting stroke, respectively. However, in order to attain the above-mentioned objects of the present invention, it is necessary to design the distance between the transit Points at the angles of 60° and 90° of the center T of the planetary gear II from the starting Point $T_0$ with respect to the center of the sun gear I so that movement corresponding to the lifting amount E between the transit points of 60° and 90° will not be imparted to the feed bars before the clamping operation completes.

Figure 4:
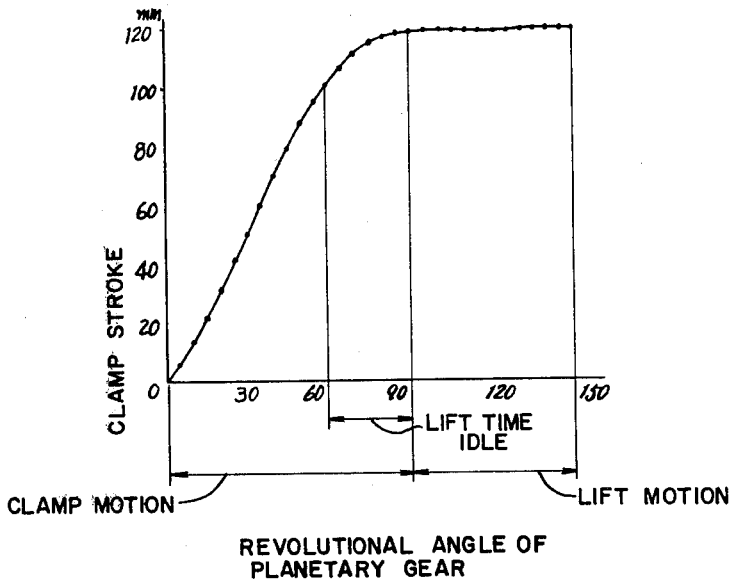
FIG. 4 is a diagram showing the relationship between angle of the movement of the planetary gear and the clamping and lifting strokes during the clamping and lifting operations in one embodiment of the present invention.
Figure 5:
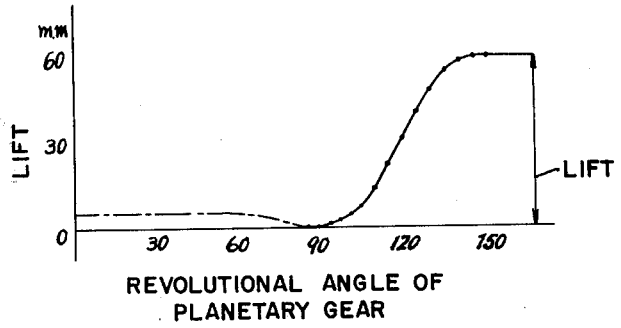
FIG. 5 is a diagram showing variations in the lift amount for the crank angles as shown in FIG. 4.

The diagram of FIG. 4 shows the relationship between the moving angle of the planetary gear and the lifting strokes for performing the clamping and lifting operations and the diagram of FIG. 5 shows the relationship between lifting amounts of the feed bars for the crank angles as shown in FIG. 4, respectively.

Figure 6:
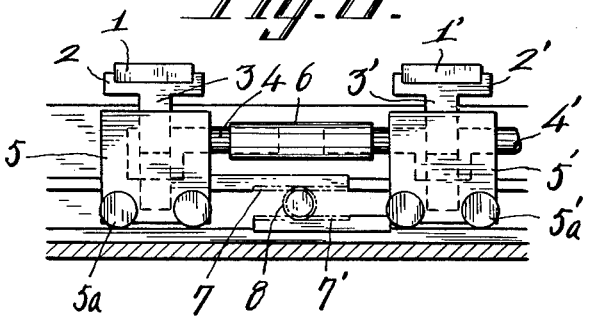
FIGS. 6 and 7 are front and side elevational views showing the basic construction of the feed device according to the present invention with a portion thereof broken away, respectively.
Figure 7:
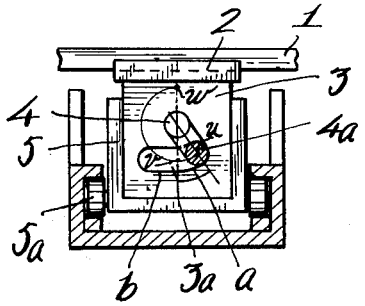

FIGS. 6 and 7 show the basic construction of the three-dimensional feed device of the present invention and in these Figures, feed bars 1, 1′ are slidably supported on guides 2, 2′, respectively, for movement in the longitudinal direction and the guides 2, 2′ and their integral guide plates, 3, 3′ are, respectively, supported by carts 5, 5′ which are in turn movably supported on retainers 10, 10′ (FIG. 9) by rollers 5*a*, 5*a*′, respectively. The guide plates 3, 3′ have axial through bores 3*a*, 3′*a*, respectively, through which the eccentric shafts 4*a*, 4′*a* of crank shafts 4, 4′ extend loosely and the crank shafts 4, 4′ are disposed in a coaxial relationship and connected together by a spline sleeve 6 so that the crank shafts may rotate in unison and also move slidably relative to each other. The rack 7 internal with the cart 5 and the rack 7′ integral with the cart 5′ mesh a common idle pinion 11 (FIG. 9) so that the carts 5, 5′ may move toward each other or in the clamping direction and away from each other or in the unclamping direction. The axial through bores 3*a*, 3′*a* in the guide plates 3, 3′ through which the eccentric shafts 4*a*, 4′*a* of the crank shafts 4, 4′ extend loosely are not simple elongated slots, but in the form of a complex slot consisting of a circular arc portion *a* having the axis 4*c* of the crank eccentric shaft 4*a* or 4′*a* as its center within the crank angle up to about 33° from a vertical plane containing the crank eccentric shaft axis 4*c* and a linear extension *b* at right angles to the above-mentioned vertical plane as shown in FIG. 7.

As to the relationship between the crank eccentric shaft 4*a* and the center T of the planetary gear II (FIG. 2), as the center T of the planetary gear II moves from the 60° position to the 90° position along the locus of the gear center as seen in FIG. 3 or the eccentric point P moves describing the arc *r* as seen in FIG. 3, the eccentric shaft 4*a* of the crank shaft 4 rotates from the point *u* to the point *v* along the circular arc portion *a* of the axial through bore 3*a*. During this rotation of the eccentric shaft 4*a*, the shaft reaches the lifting operation start position without lifting the guide plate 3 and the center T of the planetary gear II rotates to the 150° angle position as seen in FIG. 3 and as the eccentric shaft 4*a* rotates by the angular distance of 180° from the point *v* to the point *w* in engagement with the straight extension *b* of the axial through bore 3*a* and lift the guide plate 3 so as to lift the feed bar. In this way, the feed bar performs a perpendicularly angular movement as the feed bar translates from the clamping operation to the lifting operation.

The clamping and unclamping operation of the feed bars can be effected by imparting the linear movement of the eccentric point P within the linear distance C from Point A to Point B as seen in FIGS. 2 and 3 to one of the carts 5 to move the cart 5 in the clamping direction (or unclamping direction) to thereby move the other cart 5′ symmetrically with the cart 5 in the clamping (or unclamping) direction through the rack 7, idle pinion 8 and rack 7′.

One preferred embodiment of three-dimensional feed device of the present invention will be described referring to FIGS. 8 through 15.

Figure 8:
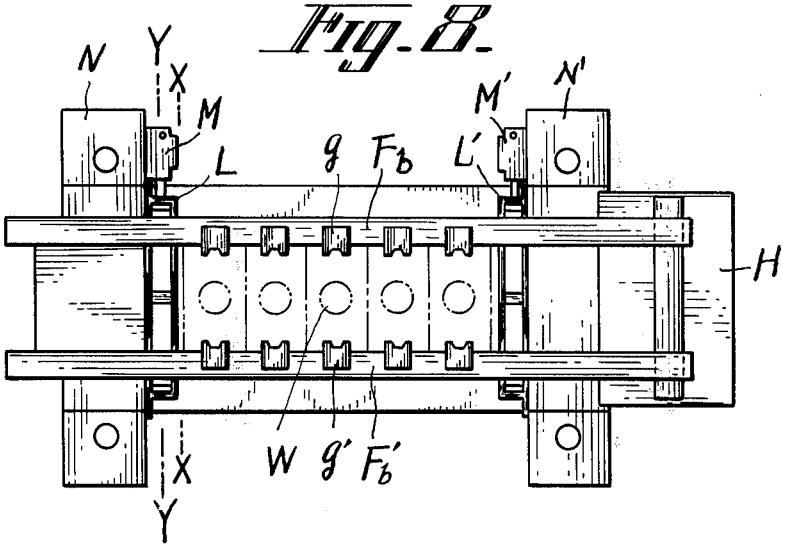
Figure 5:
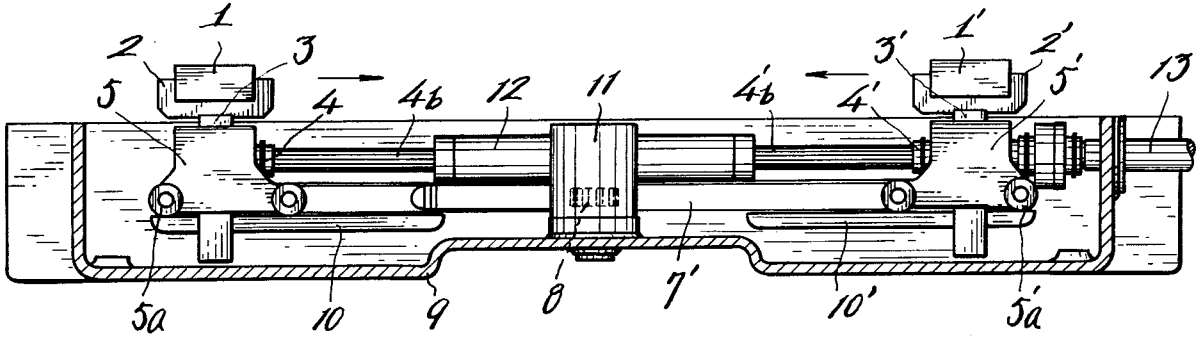

FIG. 8 schematically shows the general construction of a transfer press in which the three-dimensional feed device of the invention is incorporated. In this Figure, character references N and N′ denote spaced left-hand and right-hand columns of the machine frame, respectively, reference characters $F_b$ and $F_b'$ denote a pair of opposed and spaced feed bars each having a plurality of clampers *g*, *g*′ which face each other, character reference H denotes the advance and return drive unit for the feed bars and reference character W denotes a work. Character references L and L′ denote clamp lift units and character references M and M′ denote clamp lift drive units, respectively.

Figure 16:
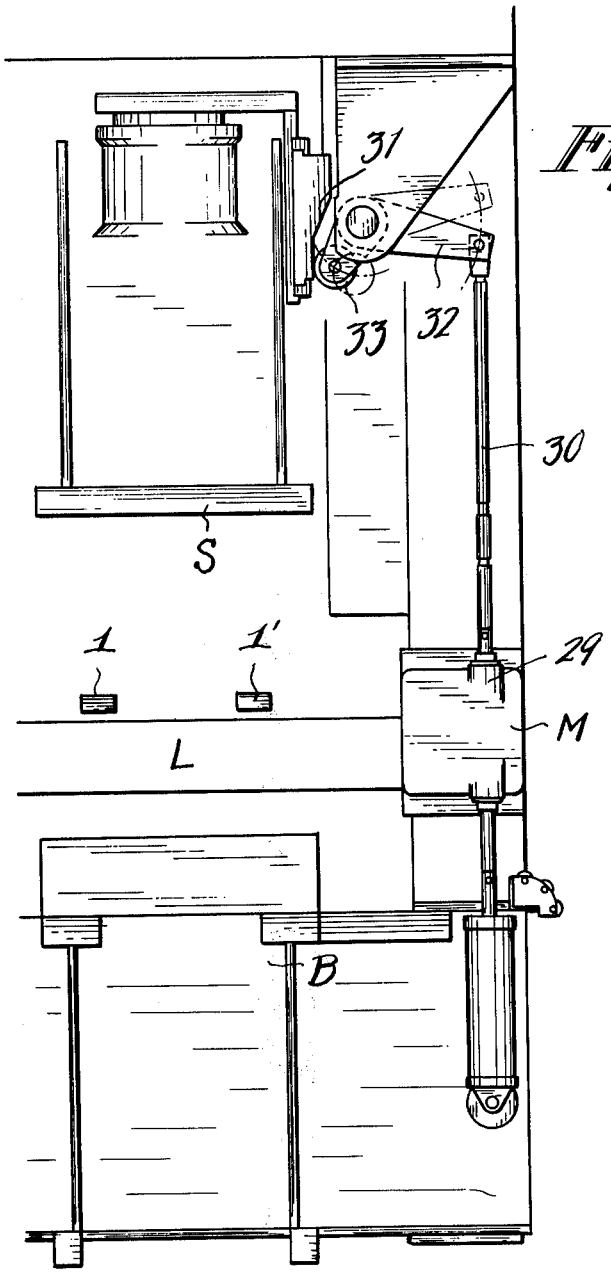

In FIG. 16, character reference S denotes the slide of the press, character reference B donotes the head, character reference L denotes the clamp lift unit, character reference M denotes the clamp drive unit and character references F and F′ denote the feed bars and the clamp drive unit M is driven in the manner as will be in detail described hereinbelow in response to the vertical movement of a rod 30 connected to one end of a lever 32 which is connected at the other end through a roller 33 to a cam 31 which moves vertically together with the slide S.

Figure 10:
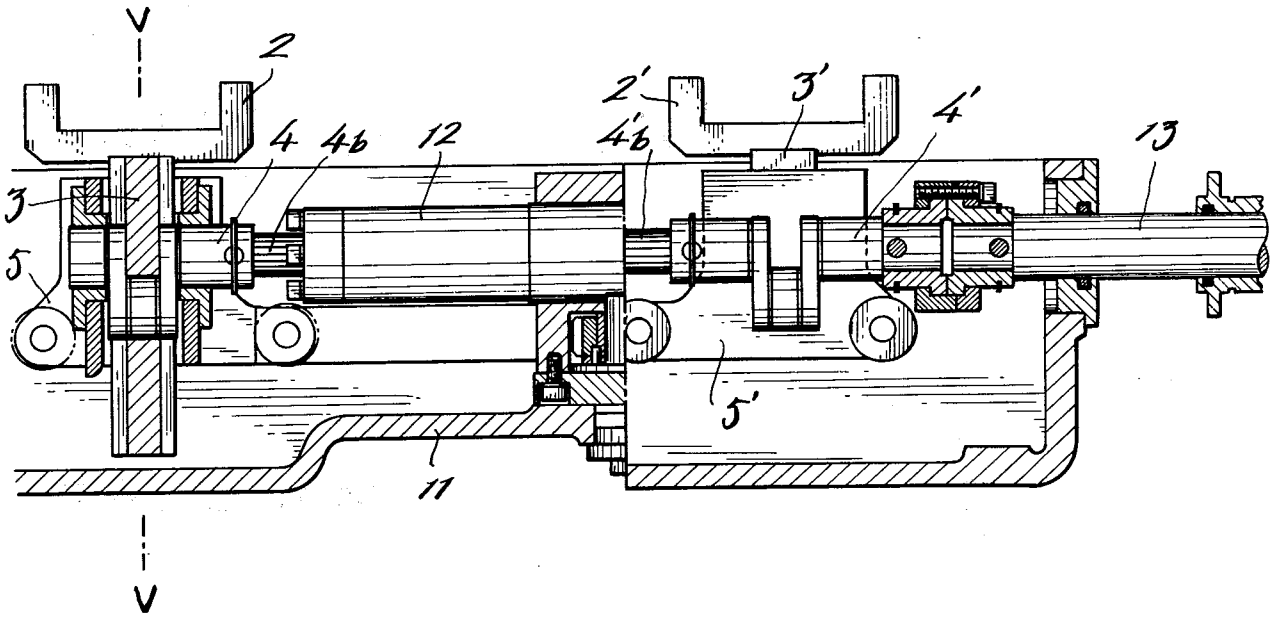
Figure 11:
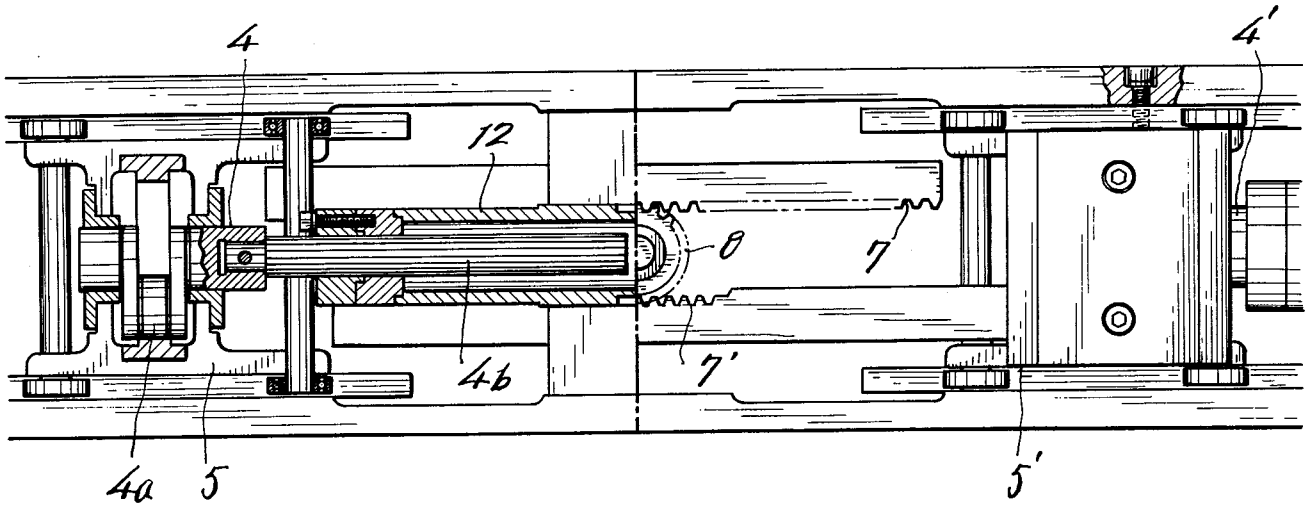
Figure 12:
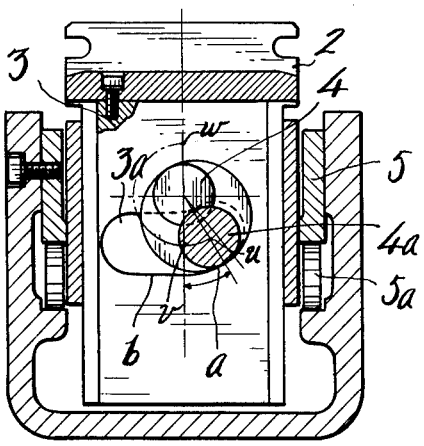

In FIGS. 9 through 12, the guide plates 3, 3′ integral with the guides 2, 2′ for the feed bars 1, 1′ are, respectively, supported for vertical movement in the carts 5, 5′ the rollers 5*a*, 5′*a* of which are supported on the retainers 10, 10′. The guide plate 3 has the axial through bore 3*a* as shown in FIGS. 10 and 12 and the eccentric shaft 4*a* of the crank shaft 4 journalled in the cart 5 extends loosely through the axial bore 3*a* (since the guide plate 3′ is identical with the guide plate 3, the description on the guide plate is eliminated herein).

Extension shafts 4*b* and 4′*b* are connected at one end to the opposed ends of the left-hand and right-hand crank shafts 4 and 4′ and splined at the other end to the opposite ends of the sleeve 12. One end of the crank shaft 4′ is connected through a coupling to a drive shaft 13 of which description will be described hereinbelow. As will be described hereinbelow, the drive shaft 13 is adapted to move reciprocally in the axial direction and also rotate and when the drive shaft 13 is moved leftwards in the axial direction to move the crank shaft 4′ leftwards, the cart 5′ is also moved leftwards in the axial direction. Thus, the rack 7′ associated with the cart 5′ moves the rack 7 rightwards in the axial direction through the pinion 8 and accordingly, moves the other cart 5 associated with the rack 7 rightwards in the axial direction. When the drive shaft 13 is moved rightwards in the axial direction, the axially rightward movement of the drive shaft 13 moves the cart 5′ rightwards and the cart 5 leftwards in the axial direction, respectively. Thus, it will be understood that when the carts 5, 5′ and accordingly, the feed bars 2, 2′ associated with the carts move toward each other the clamping action is provided and on the other hand, when the guide bars 2, 2′ moves away from each other the unclamping action is provided.

Figure 13:
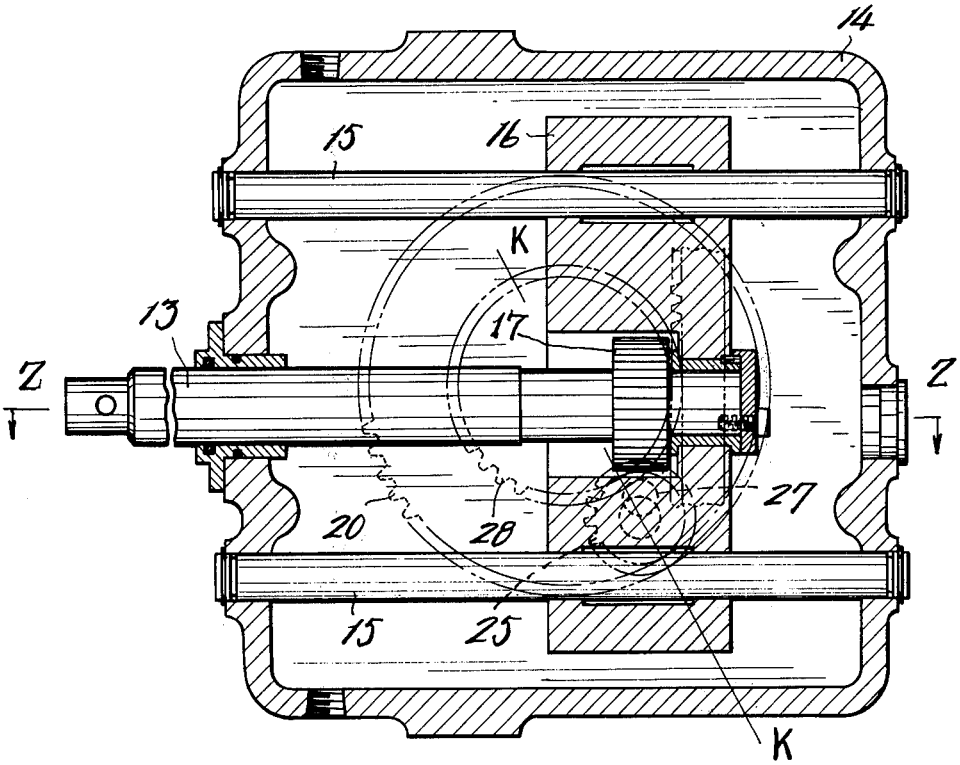
Figure 10:
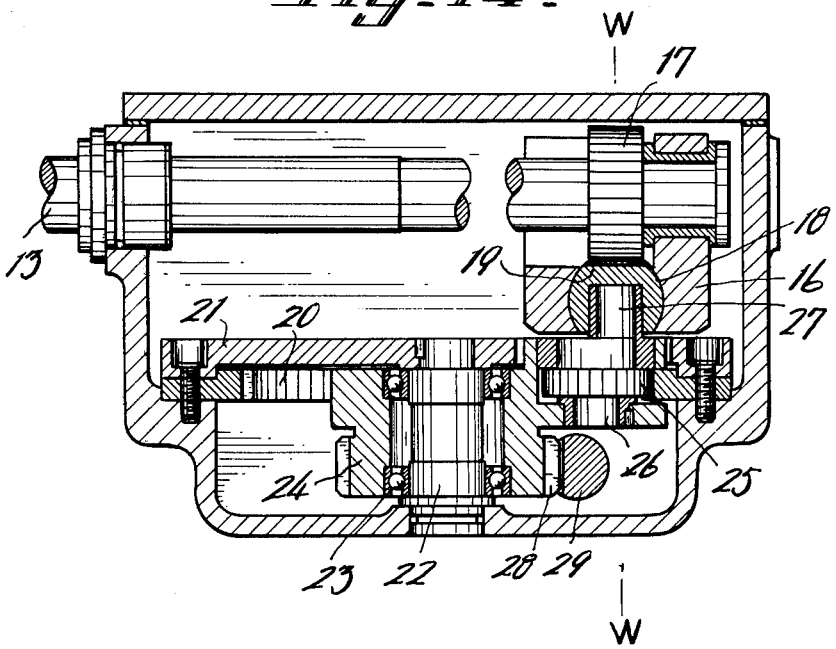
Figure 15:
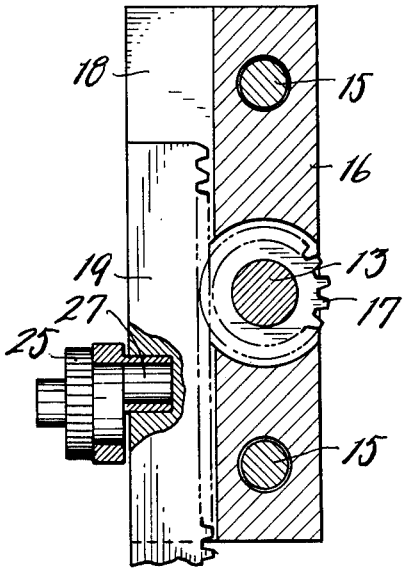

The rotational and axial movements of the drive shaft 13 are produced in the following manner:

In FIGS. 13, 14 and 15, the drive shaft 13 is rotatably connected in one end portion to a slide block 16 slidably supported on stationary guide bars 15, 15′ within a casing 14 and has a pinion 17 secured thereto in the one end portion in the slide block 16. The pinion 17 meshes a rack 19 slidably received in a groove 18 formed in the slide block 16 and extending at right angles to the slidable movement direction of the slide block 16 (FIG. 15). The internal sun gear 20 is held in position by means of a holder 21 within the casing 14 and the planetary gear 25 meshes the sun gear with the shaft 26 of the planetary gear rotatably supported in a rotary support member 24 which is in turn journalled by bearings 23 on a shaft 22 coaxial with the sun gear 20. The planetary gear 25 has a pin 27 projecting therefrom in an eccentric position of the gear and received loosely in the slidable rack 19. The rotary support member 24 has a gear 28 integrally formed therewith and meshes a rack 29 connected to the lower end of the operation rod 30 (FIG. 16).

As the slidable rack 29 reciprocally moves upwardly and downwardly in response to the upward and downward movement of the slide S, the gear 28 causes the rotary support member 24 to effect a reciprocal movement at a constant angle and in consequence, the planetary gear 25 supported by the rotary support member 24 effects a planetary movement while meshing the sun gear 20. In this case, the movement of the eccentric pin 27 on the planetary gear 25 is a reciprocal movement covering the distance between Points A and B as seen in FIGS. 2 and 3.

As the eccentric pin 27 effects the above-mentioned reciprocal movement, the eccentric pin slides the slidable rack 19 in which the pin is received within the groove 18 and the slidable rack 19 moves the movable block 16 along the guide bars 15 in one or the other direction resulting in the reciprocal movement of the drive shaft 13 in the axial direction. At the same time, the slidable movement of the rack 19 also rotates the pinion 17 meshing the rack so as to reciprocally rotate the drive shaft 13 at a constant angle.

More particularly, the reciprocal upward and downward movement of the rack 29 caused by the reciprocal upward and downward movement of the press slide S with the intermediary of the operation rod 30 is converted into the reciprocal axial movement by a constant linear distance and reciprocal rotational movement of the drive shaft 13 by a constant angular distance through the planetary gear 25, the eccentric pin 27 on the gear and pinion 17. In this case, the movement locus of the eccentric pin 27 is represented by the movement from Point A to Point B and that from Point B to Point A as seen in FIG. 3.

As the drive shaft 13 reciprocally moves in the axial direction as mentioned hereinabove, the carts 5, 5′ are caused to move toward and away from each other and in the movement stroke C of FIG. 2, the feed bars 1, 1′ clamp and unclamp a work. And the reciprocal rotational movement of the drive shaft 13 is transmitted to the crank shafts 4, 4′ and in consequence, the crank eccentric shafts 4*a*, 4′*a* cause the guide plates 3, 3′ to move upwardly and downwardly whereby the feed bars 1, 1′ is imparted thereto the lifting and descending actions in the distance D as seen in FIG. 2.

As mentioned hereinabove in connection with FIGS. 6 and 7, since the through holes 3*a*, 3′*a* in the guide plates 3, 3′ through which the crank eccentric shafts 4*a*, 4′*a* extend each consists of the circular arc portion *a* having the crank shaft axis 4*c* or 4′*c* as its center and the linear portion *b* at right angles to an upright plane containing the crank shaft center 4*c* or 4′*c*, during the movement of the eccentric shafts 4*a*, 4′*a* through holes 3*a*, 3′*a* by an angular distance of about 33° along the associated, respectively, the eccentric shafts 4*a*, 4′*a* will not lift (or lower) the guide plates 3, 3′ and during the movement of the eccentric shafts 4*a*, 4′*a* along the linear portions *b* of the associated through holes 3, 3′, the guide plates 3, 3′ are moved upwardly (or downwardly), whereby the lifting and descending actions are provided.

The rotational movement of the crank shafts 4, 4′ has such a predetermined relationship to the upward and downward slidable movement of the slidable rack 19 caused by the rotational movement of the eccentric pin 27 on the planetary gear 25 that the crank shafts 4, 4′ cause the feed bars 1, 1′ to perpendicularly translate from the terminal of the clamping stroke to the unclamping stroke without describing any arcuate locus at the end of the clamping operation represented by the distance C as seen in FIG. 2 or in the distance between Points A′ and B′ as seen in FIG. 3 and similarly, the crank shafts 4, 4′ also cause the feed bars 1, 1′ to perpendicularly translate from the terminal of the descending stroke D to the unclamping stroke C.

As mentioned hereinabove, according to the present invention, since the translation of the feed bars from the clamping stroke to the lifting stroke and the translation of the feed bars from the downward stroke to the unclamping stroke are perpendicular movements, but not circular arc movements, the clamping and unclamping of a work by the feed bars are positive and the stable clamping, lifting, advance, descending, unclamping and return movements of the feed bars can be provided when driven by the single drive source whereby the three-dimensional feed device in the transfer press can be operated at higher speeds.

While only one embodiment of the invention has been shown and described in detail, it will be understood that the same is for illustration purpose only and not to be taken as a definition of the invention, reference being had for this purpose to the appended claims.

We claim:

1. In a three-dimensional feed device in a transfer press for feeding work by successive clamping, lifting, advance, descending, unclamping and return movements of a pair of feed bars, characterized in that guide plates are integrally formed with a feed bar guide and having a through axial bore consisting of a circular arc portion and a linear portion, crank shafts each having an eccentric portion loosely extending through a respective one of said axial bores, a drive shaft fixedly connected to one of said crank shafts and rotatably supported in a slide block slidably supported in a stationary casing, an internal sun gear fixedly secured to said stationary casing, a planetary gear having a tooth number ratio of 1 : 4 with respect to said sun gear and rotatably journalled in a rotary support member for rotational movement in a coaxial relationship to said sun gear in response to the upward and downward movement of the slide of said press, said planetary gear having an eccentric pin, a slidable rack slidably received in said block at right angles to the slidable movement direction of the slide block within said stationary casing and a pinion secured to said drive shaft in operative engagement with said eccentric pin.

2. The device as set forth in claim 1, in which said eccentric pin on the planetary gear reciprocally moves along loci at right angles to each other.

3. The device as set forth in claim 1, in which a pair of feed bar guides supporting said feed bars are supported in carts, and said feed bars effect clamping and unclamping movements when the bars move toward and away from each other in response to the movement of said drive shaft in one or the other axial direction.

4. The device as set forth in claim 1, in which said rotary support member supporting said planetary gear is imparted thereto rotational movement by the upward and downward movement of a rod connected to one end of a lever having the other end engaging a cam formed on said press slide.

* * * * *